US008662026B2

(12) United States Patent
Azevedo et al.

(10) Patent No.: US 8,662,026 B2
(45) Date of Patent: Mar. 4, 2014

(54) PISTON WITH SUPPLEMENTAL COOLING GALLERY AND INTERNAL COMBUSTION ENGINE THEREWITH

(75) Inventors: Miguel Azevedo, Ann Arbor, MI (US); Warran Boyd Lineton, Ann Arbor, MI (US); Keith Hampton, Ann Arbor, MI (US)

(73) Assignee: Federal-Mogul Corporation, Southfield, MI (US)

( * ) Notice: Subject to any disclaimer, the term of this patent is extended or adjusted under 35 U.S.C. 154(b) by 198 days.

(21) Appl. No.: 13/370,695

(22) Filed: Feb. 10, 2012

(65) Prior Publication Data

US 2013/0206084 A1 Aug. 15, 2013

(51) Int. Cl.
*F01P 1/04* (2006.01)

(52) U.S. Cl.
USPC ..... 123/41.35; 92/186

(58) Field of Classification Search
USPC ..... 123/41.35, 193.6; 92/186
See application file for complete search history.

(56) References Cited

U.S. PATENT DOCUMENTS

| | | | | |
|---|---|---|---|---|
| 1,953,109 | A * | 4/1934 | Heron | 92/186 |
| 3,358,349 | A | 12/1967 | Rosen | |
| 3,545,341 | A | 12/1970 | Fischer | |
| 4,129,108 | A | 12/1978 | Elsbett et al. | |
| 4,253,430 | A | 3/1981 | Garter et al. | |
| 4,312,106 | A | 1/1982 | Wanner et al. | |
| 4,694,813 | A | 9/1987 | Mielke | |
| 4,702,151 | A | 10/1987 | Munro et al. | |
| 4,862,865 | A | 9/1989 | Dahlen et al. | |
| 7,654,240 | B2 | 2/2010 | Jarrett et al. | |

FOREIGN PATENT DOCUMENTS

| | | | |
|---|---|---|---|
| DE | 2424882 | A1 | 12/1975 |
| JP | 61132756 | | 6/1986 |
| JP | 2007146819 | A | 6/2007 |

OTHER PUBLICATIONS

International Search Report mailed Jul. 9, 2013 (PCT/US2013/025266).

* cited by examiner

*Primary Examiner* — Noah Kamen
(74) *Attorney, Agent, or Firm* — Robert L. Stearns; Dickinson Wright, PLLC

(57) ABSTRACT

An internal combustion engine and piston therefor is provided. The piston has a body including an upper combustion wall, a cylindrical outer wall including a ring belt region depending from the upper combustion wall, and a pair of pin bosses having axially aligned pin bores. The piston has a first cooling gallery in radial alignment with the ring belt region with a cooling medium contained therein. An insert member is fixed to the body in axially spaced relation beneath a lower wall of the first cooling gallery. The insert member bounds a second cooling gallery beneath the lower wall of the first cooling gallery. The insert member has an inlet opening configured to allow oil to flow into the second cooling gallery against the lower wall of the first cooling gallery and a separate outlet opening configured to allow the oil to flow outwardly from the second cooling gallery.

22 Claims, 3 Drawing Sheets

PISTON WITH SUPPLEMENTAL COOLING GALLERY AND INTERNAL COMBUSTION ENGINE THEREWITH

BACKGROUND OF THE INVENTION

1. Technical Field

This invention relates generally to internal combustion engines, and more particularly to pistons therefor.

2. Related Art

Engine manufacturers are encountering increasing demands to improve engine efficiencies and performance, including, but not limited to, improving fuel economy, improving fuel combustion, reducing oil consumption, increasing the exhaust temperature for subsequent use of the heat within the vehicle, increasing compression loads within the combustion chambers of cylinder bores, decreasing weight and making engines more compact. Accordingly, it is desirable to increase the temperature and compression loads within the combustion chambers of the engine. However, by increasing the temperature and compression loads within the combustion chambers, the wear and physical demands on the piston are increased, thereby reducing its potential useful life. A particular area of concern is with the excessive heat buildup and associated wear within the upper combustion surface region and piston ring region of the piston.

A piston constructed in accordance with this invention is able to better withstand the excessive heat generated in modern high performance engines, as will become apparent to those skilled in the art upon reading the disclosure and viewing the drawings herein.

SUMMARY OF THE INVENTION

In accordance with one aspect of the invention, a piston for an internal combustion engine is provided. The piston has a body that extends along a longitudinal central axis along which the piston reciprocates. The body has an upper combustion wall providing an upper combustion surface against which combustion forces act, a cylindrical outer wall including a ring belt region depending from the upper combustion surface, and a pair of pin bosses having axially aligned pin bores beneath the upper combustion wall. The piston further includes a first cooling gallery in radial alignment with the ring belt region. The first cooling gallery has an upper wall adjacent the upper combustion surface and a lower wall. A cooling medium is contained in the first cooling gallery. An insert member is fixed to the body in axially spaced relation beneath the lower wall. The insert member bounds a second cooling gallery between the insert member and the lower wall of the first cooling gallery. The insert member has an inlet opening configured to allow oil to flow into the second cooling gallery against the lower wall of the first cooling gallery and an outlet opening configured to allow the oil to flow outwardly from the second cooling gallery.

In accordance with another aspect of the invention, an internal combustion engine is provided. The engine includes an engine block having a cylinder bore and an oil jet configured to inject oil within the cylinder bore. The engine further includes a piston received in the cylinder bore for reciprocation along a longitudinal central axis. The piston has a body extending along the longitudinal central axis. The body has an upper combustion wall providing an upper combustion surface and a cylindrical outer wall having a ring belt region depending from the upper combustion surface. The piston also includes a pair of pin bosses beneath the upper combustion wall with a first cooling gallery in radial alignment with the ring belt region. The first cooling gallery has an upper wall adjacent the upper combustion surface and a lower wall with a cooling medium being contained in the first cooling gallery. An insert member is fixed to the body. The insert member is spaced axially beneath the lower wall of the first cooling gallery and bounds a second cooling gallery between the insert member and the lower wall of the first cooling gallery. The insert member has an inlet opening and an outlet opening. The inlet opening is configured in alignment with the oil jet to allow the oil injected from the oil jet to flow into the second cooling gallery against the lower wall of the first cooling gallery. The outlet opening is configured to allow the oil to flow outwardly from the second cooling gallery.

Accordingly, the second cooling gallery facilitates cooling the piston during use by providing an active heat sink to the first cooling gallery. As such, heat absorbed by the first cooling gallery is caused to flow to the second cooling gallery, thereby causing the heat generated in the upper combustion wall and the ring belt region to be readily dissipated. Accordingly, the operating temperature of the upper combustion wall and ring belt region is actively reduced during reciprocation of the piston, thereby enhancing the performance of the engine and extending the useful life thereof.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
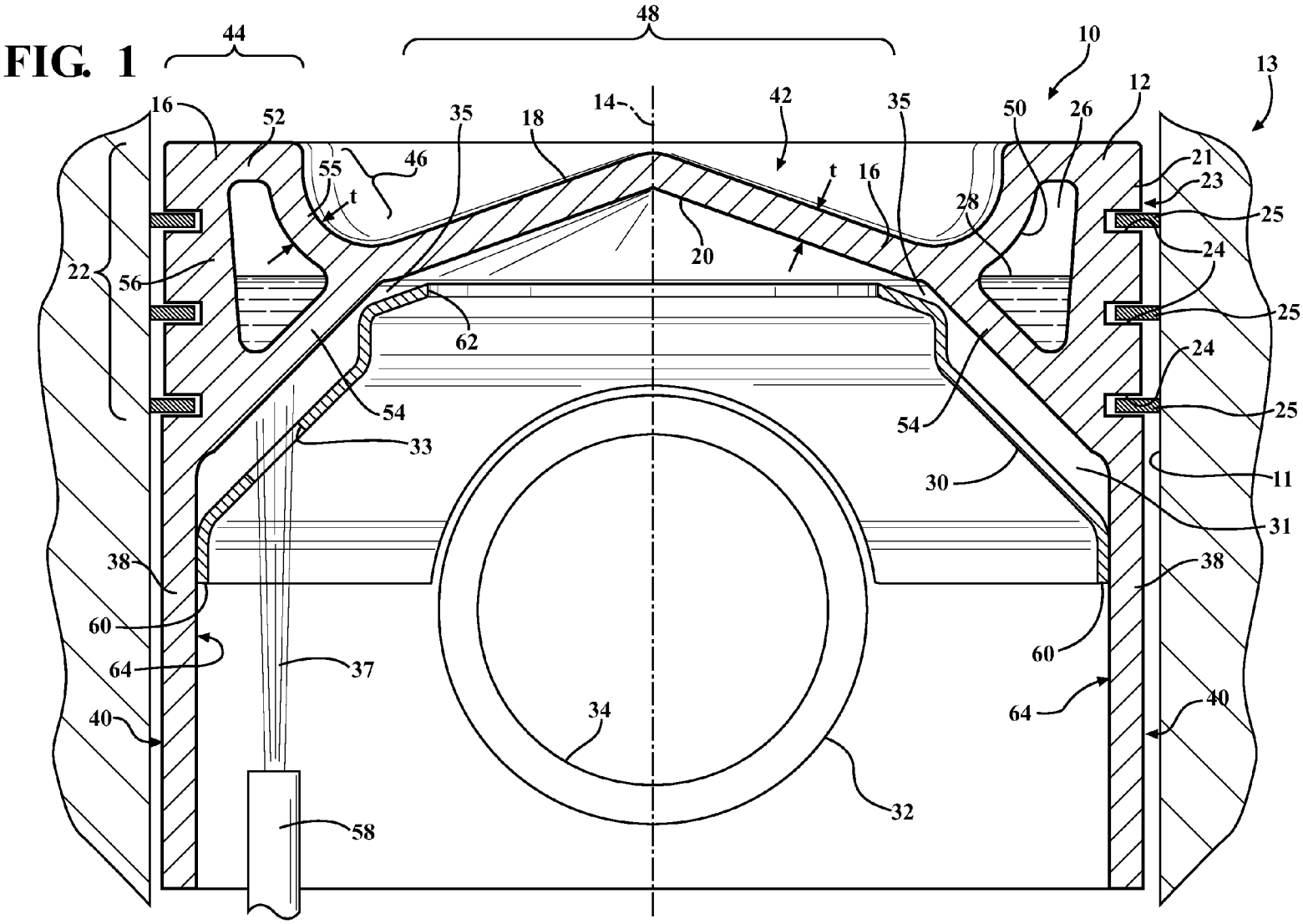
FIG. 1 is a cross-sectional view taken generally along a line extending transversely to a pin bore axis of a piston constructed in accordance with one aspect of the invention.
Figure 2:
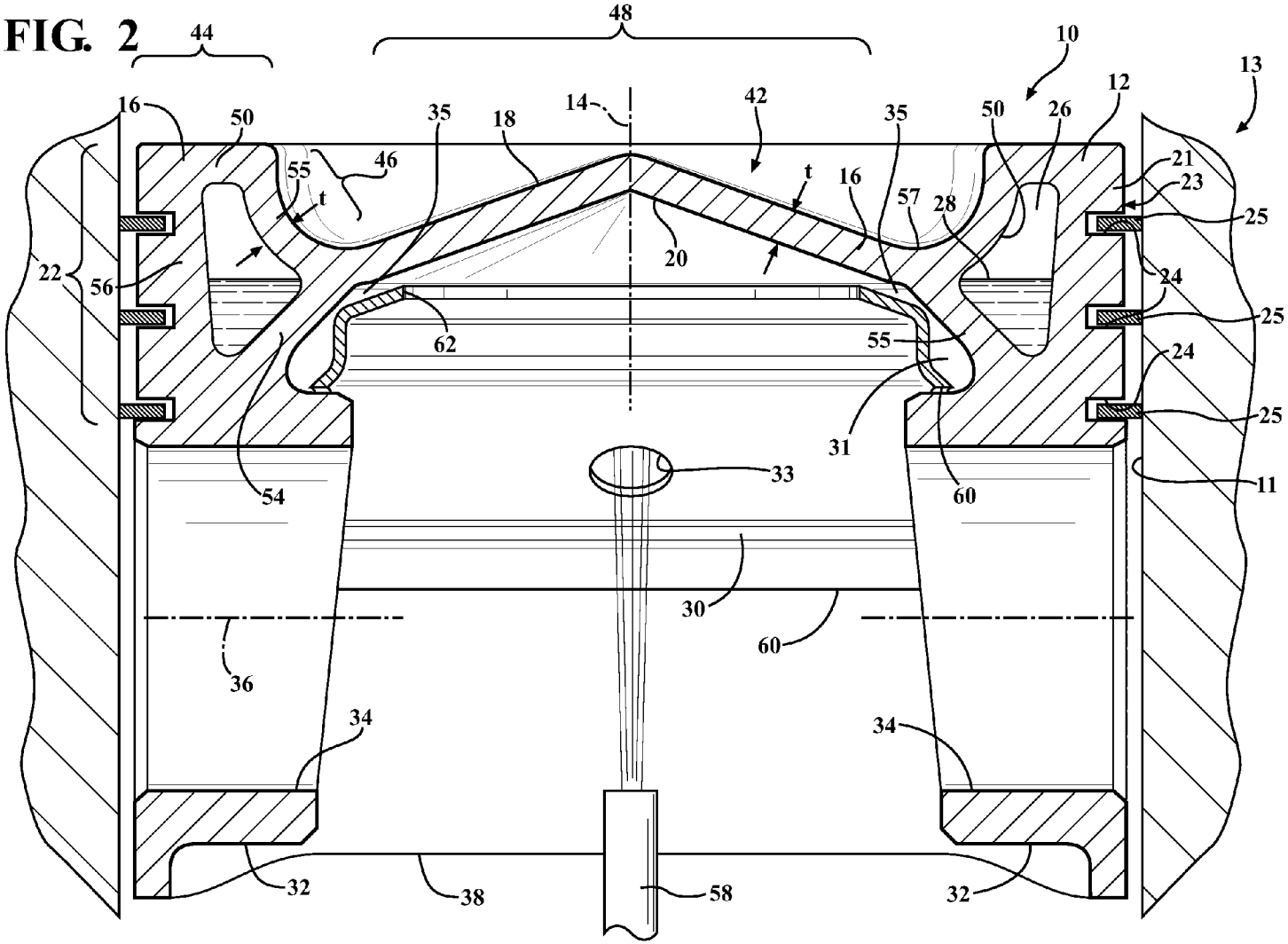
FIG. 2 is a cross-sectional view taken generally along the pin bore axis of the piston of FIG. 1.
Figure 3:
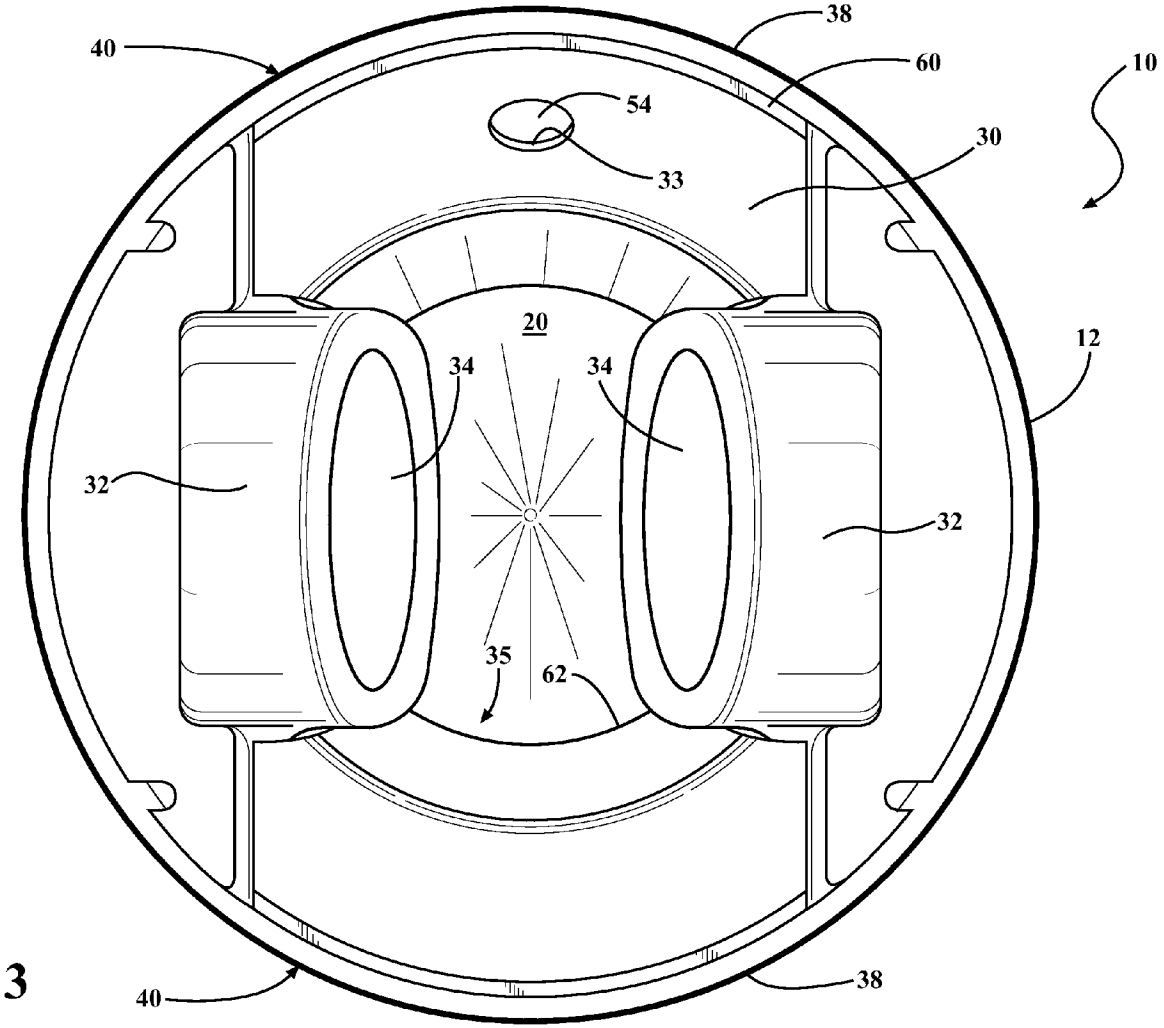
FIG. 3 is a bottom view of the piston of FIGS. 1 and 2.

Referring in more detail to the drawings, FIGS. 1-3 illustrate a various views of a piston 10 constructed in accordance with one presently preferred aspect of the invention for reciprocating movement in a cylinder bore 11 of an internal combustion engine 13, such as a modern, compact, high performance vehicle engine, for example. The piston 10 has a body 12, such as a single, monolithic piece of cast material or formed from either forged or billet materials, by way of example and without limitation, extending along a central longitudinal axis 14 along which the piston 10 reciprocates in the cylinder bore 11. The body 12 has an upper combustion wall 16 having on one side an upper combustion surface 18 configured for direct exposure to combustion gases within the cylinder bore 11 and on an opposite side an undercrown surface 20 located directly and axially beneath a portion of the upper combustion surface 18. The piston body 12 also includes a generally cylindrical outer wall 21 having a cylindrical outer surface 23 depending from the upper combustion surface 18 over a ring belt region 22 immediately adjacent the upper combustion surface 18. The ring belt region 22 includes one or more piston ring grooves 24 configured for receipt of corresponding piston rings 25. Further, the piston body 12 is formed having a closed or sealed first cooling gallery 26 with a cooling medium 28 disposed therein. The first cooling gallery 26 is configured radially inwardly and in radial alignment or substantial radial alignment with the ring belt region 22. An insert member 30 is fixed to the body 12 in axially spaced relation beneath the first cooling gallery 26 to delimit a supplemental cooling gallery, referred to hereafter as second cooling gallery 31, between the insert member 30 and the first cooling gallery 26. The insert member 30 has an inlet opening 33 configured to allow a jet stream of oil 37 to flow into the second cooling gallery 31 and an outlet opening 35 configured to allow the oil to flow outwardly from the second cooling gallery 33.

The cooling medium 28 in the first cooling gallery 26 can be provided entirely as a metallic coolant, which is liquid at operating temperature of the piston 10. Any suitable metallic material could be used, taking into account the heat transfer properties desired. Further, the cooling medium 28 can be provided as a liquid metal mixed with powdered metal, such as copper or aluminum. The addition of metallic powder can be used particularly when it is desired to change the thermal properties of the cooling medium 28. Further yet, heat transfer liquids, such as those typically used for industrial heat exchanging, can be used.

As best shown in FIG. 2, the piston body 12 has a pair of pin bosses 32 depending from the undercrown surface 20 to provide laterally spaced pin bores 34 coaxially aligned along a pin bore axis 36 that extends generally transverse to the central longitudinal axis 14. The pin bosses 32 are joined to laterally spaced skirt portions 38 that are diametrically spaced from one another across opposite sides the pin bore axis 36 and have convex outer surfaces 40 contoured for sliding movement within the cylinder bore 11 to facilitate maintaining the piston 10 in its desired orientation as it reciprocates within the cylinder bore.

The upper combustion surface 16 is represented as having a combustion bowl 42 recessed therein to provide the desired gas flow within the cylinder bore 11. As a result of the combustion bowl 42 being recessed within the upper combustion surface 16, the combustion wall 16 has a relatively thin thickness (t) across its entirety, as viewed in axial cross-section. In particular, the combustion wall 16 includes a first region 44, second region 46 and a third region 48, wherein the second and third regions 46, 48 are thinned due to the recessed combustion bowl 42.

The first cooling gallery 26 has an inner surface 50 bounded by an upper wall 52 adjacent the upper combustion surface 18, a lower wall 54 and a pair of side walls 55, 56. The upper wall 52 and sidewall 55 are common walls to the upper combustion wall 16, with the sidewall 55 extending along a portion of the combustion bowl 42 and the other sidewall 56 extending along the ring belt region 22. The lower wall 54 forms a web extending between the combustion bowl 42 and a lower portion of the ring belt region 22 and is shown as extending radially upwardly and inwardly from the cylindrical outer wall 21 to the upper combustion wall 16.

The second cooling gallery 31 is considered an open cooling gallery in that oil flows freely therein via the inlet opening 33 and outwardly therefrom via the outlet opening 35. To facilitate channeling oil through the inlet opening 33 and into the second cooling gallery 31, an oil jet 58 is provided in the cylinder bore 11 of the engine 13. The oil jet 58 is configured in alignment with the inlet opening 33 to inject a stream of oil 37 directly through the inlet opening 33, at least during a portion of the piston stroke, into the second cooling gallery 31 and against the lower wall 54 of the first cooling gallery 26.

The insert member 30 is constructed as a separate piece of material from the piston body 12, such as in a stamping process, by way of example and without limitation, and is subsequently fixed to the body 12. The insert member 30 is spaced in axially aligned relation beneath the lower wall 54 of the first cooling gallery 26 and bounds the second cooling gallery 31 along one side of the second cooling gallery 31 with the other side of the second cooling gallery 31 being bound or substantially bound by the lower wall 54 of the first cooling gallery 26. Accordingly, the cooling medium 28 within the second cooling gallery 31 contacts the lower wall 54 of the first cooling gallery 26, thereby facilitating removal of heat from the first cooling gallery 26 via conduction to the second cooling gallery 31.

The insert member 30 illustrated has an annular radially outer periphery 60 and free annular radially inner periphery 62 with the inlet opening 33 being formed therebetween. The insert member 30 has a wall that extends axially upwardly and radially inwardly from the outer periphery 60 toward the upper combustion wall 16 in generally parallel relation with the lower wall 54 of the first cooling gallery 26, thereby rendering the insert member 30 generally cup-shaped and conical in form. The outer periphery 60 is fixed to the piston body 12, shown as being fixed to an inner surface 64 of the skirt portions 38, such as via a press fit, a high temperature glue bond joint, a mechanical mechanism, a weld joint, or any combination thereof. The inner periphery 62 is shown as extending in spaced relation between the pin bosses 32 and the upper combustion wall 16, thereby forming the annular outlet gap, also referred to as opening 35, extending between the insert member 30 and the undercrown surface 20 of the upper combustion wall 16. The size or width of the annular gap 35 can be controlled in manufacture of the insert member 30 to provide the desired flow rate of oil outwardly therethrough. Accordingly, the relatively simple construction process used to construct the insert member 30 allows the cooling capacity provided by the second cooling gallery 31 to be easily and precisely controlled via relatively simple manufacturing process steps used to form the configuration of the inner periphery 62.

Accordingly, the second cooling gallery 31 facilitates cooling the piston 10 as it reciprocates in the cylinder bore 11 by providing a conductive heat flow path between the first cooling gallery 26 and the second cooling gallery 31. As such, heat absorbed by the first cooling gallery 26 is caused to flow to the second cooling gallery 31, thereby allowing the heat generated in the upper combustion wall 16 and the ring belt region 22 to be readily dissipated to the engine block 13, and ultimately to the surrounding environment. Accordingly, the operating temperature of the piston 10, and particularly the upper combustion wall 16 and ring belt region 22, is actively reduced during reciprocation of the piston 10, thereby enhancing the performance of the engine 13 and extending the useful life thereof.

Obviously, given the detailed description of presently preferred embodiments discusses above, many modifications and variations of the present invention are possible in light of the above teachings. It is, therefore, to be understood that within the scope of the appended claims, the invention may be practiced otherwise than as specifically described.

What is claimed is:

1. A piston for an internal combustion engine, comprising:

a body extending along a longitudinal central axis, said body including an upper combustion wall providing an upper combustion surface, a cylindrical outer wall with a ring belt region depending from said upper combustion surface, a pair of pin bosses beneath said upper combustion wall;

a first cooling gallery in radial alignment with said ring belt region, said first cooling gallery having an upper wall adjacent said upper combustion surface and a lower wall;

a cooling medium contained in said first cooling gallery; and an insert member fixed to said body, said insert member being spaced axially beneath said lower wall and bounding a second cooling gallery between said insert member and said lower wall of said first cooling gallery, said insert member having an inlet opening configured to allow oil to flow into said second cooling gallery against said lower wall of said first cooling gallery and an outlet opening configured to allow the oil to flow outwardly from said second cooling gallery.

2. The piston of claim 1 wherein said insert member has an outer periphery fixed to said body.

3. The piston of claim 2 wherein said insert member has wall extending from said outer periphery to a free inner periphery.

4. The piston of claim 3 wherein said inlet opening is formed in said wall between said inner periphery and said outer periphery.

5. The piston of claim 3 wherein said free inner periphery forms said outlet opening.

6. The piston of claim 5 wherein said free inner periphery is spaced from said upper combustion wall.

7. The piston of claim 6 wherein said free inner periphery is an annular gap.

8. The piston of claim 7 wherein said free inner periphery extends in spaced relation between said pin bosses and said upper combustion wall.

9. The piston of claim 3 wherein said wall of said insert member extends radially inwardly from said outer periphery toward said upper combustion wall.

10. The piston of claim 1 wherein said inlet opening is configured in alignment with an oil jet to allow oil to be injected from the oil jet into said second cooling gallery.

11. The piston of claim 1 wherein said body has a pair of diametrically spaced skirt portions and said inert member is fixed to an inner surface of said skirt portions.

12. An internal combustion engine, comprising:

an engine block having a cylinder bore;

an oil jet configured to inject oil in said cylinder bore; and a piston received in said cylinder bore for reciprocation along a longitudinal central axis, said piston having a body extending along said longitudinal central axis, said body including an upper combustion wall providing an upper combustion surface, a cylindrical outer wall with a ring belt region depending from said upper combustion surface, a pair of pin bosses beneath said upper combustion wall, a first cooling gallery in radial alignment with said ring belt region, said first cooling gallery having an upper wall adjacent said upper combustion surface and a lower wall, a cooling medium contained in said first cooling gallery, an insert member fixed to said body, said insert member being spaced axially beneath said lower wall and bounding a second cooling gallery between said insert member and said lower wall of said first cooling gallery, said insert member having an inlet opening configured in alignment with said oil jet to allow the oil injected from said oil jet to flow into said second cooling gallery against said lower wall of said first cooling gallery and having an outlet opening configured to allow the oil to flow outwardly from said second cooling gallery.

13. The internal combustion engine of claim 12 wherein said insert member has an outer periphery fixed to said body.

14. The internal combustion engine of claim 13 wherein said insert member has wall extending from said outer periphery to a free inner periphery.

15. The internal combustion engine of claim 14 wherein said inlet opening is formed in said wall between said inner periphery and said outer periphery.

16. The internal combustion engine of claim 14 wherein said free inner periphery forms said outlet opening.

17. The internal combustion engine of claim 16 wherein said free inner periphery is spaced from said upper combustion wall.

18. The internal combustion engine of claim 17 wherein said free inner periphery is an annular gap.

19. The internal combustion engine of claim 18 wherein said free inner periphery extends in spaced relation between said pin bosses and said upper combustion wall.

20. The internal combustion engine of claim 14 wherein said wall of said insert member extends radially inwardly from said outer periphery toward said upper combustion wall.

21. The internal combustion engine of claim 12 wherein said inlet opening is configured in alignment with an oil jet to allow oil to be injected from the oil jet into said second cooling gallery.

22. The internal combustion engine of claim 12 wherein said body has a pair of diametrically spaced skirt portions and said inert member is fixed to an inner surface of said skirt portions.

* * * * *